US010753112B1

(12) United States Patent
Scott

(10) Patent No.: US 10,753,112 B1
(45) Date of Patent: Aug. 25, 2020

(54) MULTIPURPOSE FLOOR DEMOLITION TOOL

(71) Applicant: Bryan A. Scott, Central Point, OR (US)

(72) Inventor: Bryan A. Scott, Central Point, OR (US)

( * ) Notice: Subject to any disclaimer, the term of this patent is extended or adjusted under 35 U.S.C. 154(b) by 20 days.

(21) Appl. No.: 16/032,016

(22) Filed: Jul. 10, 2018

Related U.S. Application Data

(60) Provisional application No. 62/534,289, filed on Jul. 19, 2017.

(51) Int. Cl.

| | |
|---|---|
| ***E04G 23/00*** | (2006.01) |
| ***B25F 1/00*** | (2006.01) |
| ***B25D 1/04*** | (2006.01) |
| ***E04G 23/08*** | (2006.01) |
| ***B25G 1/10*** | (2006.01) |
| *A47L 13/08* | (2006.01) |
| *B25G 1/06* | (2006.01) |
| *E04F 21/20* | (2006.01) |

(52) U.S. Cl.
CPC ..... *E04G 23/006* (2013.01); *B25D 1/04* (2013.01); *B25F 1/006* (2013.01); *B25G 1/102* (2013.01); *E04G 23/08* (2013.01); *A47L 13/08* (2013.01); *B25G 1/06* (2013.01); *E04F 21/20* (2013.01)

(58) Field of Classification Search
CPC ..... A47L 13/02; A47L 13/08; E04G 23/006; E04G 23/08; A01B 1/06; A01B 1/10–16
USPC ..... 172/371–381; 30/167–172, 277, 280, 30/294, 299–301, 309, 314, 315, 317, 30/351, 353, 357; D8/9–12, 47, 76, 81, D8/89
See application file for complete search history.

(56) References Cited

U.S. PATENT DOCUMENTS

| | | | | | |
|---|---|---|---|---|---|
| D25,918 | S | * | 8/1896 | Hepsher | D8/11 |
| D29,443 | S | * | 10/1898 | Pearson | D8/9 |
| D35,652 | S | * | 2/1902 | David et al. | D8/81 |
| D35,720 | S | * | 2/1902 | David et al. | D8/12 |
| 766,808 | A | * | 8/1904 | Buckley | B26B 23/00 D8/76 |
| D45,761 | S | * | 5/1914 | Miller | D8/76 |
| 1,317,596 | A | * | 9/1919 | Sanders | A01B 1/20 172/375 |
| 1,579,495 | A | * | 4/1926 | Stroud | A47L 13/08 30/169 |

(Continued)

*Primary Examiner* — Jason Daniel Prone
(74) *Attorney, Agent, or Firm* — Jerry Haynes Law

(57) ABSTRACT

A multipurpose floor demolition tool enables removing, scraping, manipulating, and replacing a floor and floor covering and components without having to bend down, and with a lesser application of force. The tool provides a plate that is sufficiently flat, and has a straight scraping edge for scraping, flipping over, and prying floor components. The plate forms a central aperture for prying a nail from the floor. The plate has a first curvilinear edge defined by a claw for tearing and prying floor components. The plate has a second edge defined by a tab for prying floor components. A portion of the first and second edges are perpendicular to the straight scraping edge, such that the first and second edges simultaneously engage a floor. A handle joins with the straight mounting edge to enable manipulation of the plate and provide leverage for prying and scraping floor components with the plate.

11 Claims, 7 Drawing Sheets

(56) References Cited

U.S. PATENT DOCUMENTS 1,744,909 A * 1/1930 Magnusson ..... B27L 1/06 30/169
1,886,560 A * 11/1932 Lee ..... A01B 1/12 172/375
1,946,006 A * 2/1934 Struckmeyer ..... A01B 1/06 172/375
2,040,751 A * 5/1936 Marseilles ..... A01B 1/06 172/375
2,046,334 A * 7/1936 Loeber ..... A47L 13/08 30/169
2,066,803 A * 1/1937 Sawyer ..... A01B 1/16 D8/9
D122,674 S * 9/1940 Strout ..... D8/12
2,419,719 A * 4/1947 Kennedy ..... A01B 1/06 172/372
2,421,600 A * 6/1947 Cumpston ..... A01B 1/06 172/381
2,506,083 A * 5/1950 Hollander ..... A47L 13/08 30/169
2,542,582 A * 2/1951 Schwork ..... B25C 11/02 30/314
2,650,530 A * 9/1953 Schmidt ..... A01B 1/20 172/375
D177,303 S * 4/1956 Bellin ..... D8/9
D183,916 S * 11/1958 Derwallis ..... D8/12
D202,056 S * 8/1965 Davidson ..... D8/11
3,562,826 A 2/1971 Vaughn
3,942,591 A * 3/1976 Brannin ..... A01B 1/08 172/371
4,208,793 A * 6/1980 Sinnott ..... A62C 33/00 30/314
4,377,211 A * 3/1983 Voss ..... A01B 1/20 172/375
D273,175 S * 3/1984 Ziaylek, Jr. ..... D8/81
D277,258 S * 1/1985 Baty ..... 172/375
4,564,072 A * 1/1986 Corbett ..... A01B 1/20 172/375
4,730,679 A * 3/1988 Tallerico ..... A01B 1/20 172/375
4,790,388 A * 12/1988 Badham ..... A01B 1/12 172/375
D300,715 S * 4/1989 Ragoonath ..... D8/12
4,821,609 A * 4/1989 Rushbrook ..... B26B 27/00 30/314
4,890,679 A * 1/1990 Jacobs ..... A01B 1/20 172/371
5,040,614 A * 8/1991 Nash ..... A01B 1/06 172/371
D319,952 S * 9/1991 Harvey, Sr. ..... D8/10
D354,206 S * 1/1995 Kunzle ..... D8/9
D362,164 S * 9/1995 Butcher ..... D8/10
D368,998 S 4/1996 King
5,546,625 A 8/1996 Mealey, Sr.
D391,129 S * 2/1998 Denson ..... D8/9
5,870,786 A 2/1999 Papadopoulos
6,421,860 B1 7/2002 Abbott
6,427,274 B1 8/2002 Abbott
D474,660 S * 5/2003 Travis ..... D8/11
6,564,881 B2 * 5/2003 Murtagh ..... A01B 1/08 172/371
6,920,807 B2 7/2005 Bond
7,039,983 B1 5/2006 Outlaw
D620,658 S 7/2010 Johnson
8,066,080 B1 * 11/2011 Hanson ..... A01B 1/02 172/377
8,291,996 B2 * 10/2012 Hoang ..... A01B 1/12 172/375
D690,182 S * 9/2013 Cridlebaugh ..... D8/81
D691,773 S 10/2013 Chen
8,726,450 B2 5/2014 Hoffmann
D721,557 S * 1/2015 Ward ..... D8/34
D758,153 S * 6/2016 Bryant ..... D8/11
D774,854 S * 12/2016 Aldama ..... D8/11
2006/0156685 A1 7/2006 Shank
2014/0360742 A1 * 12/2014 Finney ..... A01B 1/08 172/381

* cited by examiner

MULTIPURPOSE FLOOR DEMOLITION TOOL

CROSS REFERENCE OF RELATED APPLICATIONS

This application claims the benefits of U.S. provisional application No. 62/534,289, filed Jul. 19, 2017 and entitled MULTIPURPOSE FLOOR DEMOLITION DEVICE, which provisional application is incorporated by reference herein in its entirety.

FIELD OF THE INVENTION

The present invention relates generally to a multipurpose floor demolition tool and method of operation. More so, the demolition tool is configured to engage a floor for removing, scraping, prying, flipping, and replacing components on, and integral, with the floor in an efficient manner that leverages the shape and length of the tool so that a user does not require stooping over, kneeling, or bending down to engage the floor, and also provides a central aperture and both straight and curvilinear edges and claws that facilitate engagement with boards, tiles, adhesives, and nails on the floor.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, floor demolition involves forcibly removing a layer of the floor or subfloor with crow bars, sledge hammers, and prying tools. Thus, demolishing, or replacing a floor requires multiple functions, including prying off boards, tiles, or carpets; scraping off adhesives; flipping tiles and boars; and removing nails from the floor or flat substrate. For example, in carpet laying and vinyl installation, installers must remove vinyl or other floor covering from a floor that involves cove base. The old vinyl is underneath the cove base. The old vinyl and cove base must be pried off, and adhesives scraped off in a short period of time.

This type of floor installation work requires a tool that has straight edges and an elongate handle for prying. Also, a curvilinear edge may be necessary to adapt to corners and wall boards. This may require multiple tools and scrapers. Further, this type of labor often requires the installer to bend over or work on the knees, which is taxing and time consuming.

It is common for older homes to have lumber that is very difficult to pry apart. Conventional pry bars are of insufficient size to pry apart larger boards. Conventional pry bars quickly tire the operator out because of the added strength needed to pry apart the boards. Thus, there is a need for a tool that allows the user to safely and precisely remove flooring material while performing demolition work. In the current practice, a hammer or pry bar is used to separate the floor material from its base.

Often, sledgehammers are used in floor demolition projects. Sledgehammers are necessarily heavy however and it is often difficult for an individual to use a sledgehammer effectively for an entire work shift. Moreover, the use of sledgehammers in demolition projects often causes heavy damage to the materials comprising the structure being demolished.

Often, crowbars and pry bars are used in floor demolition projects. A crowbar relies in large part for its utility upon the ability of the operator to drive the wedge-shaped end of the crowbar between the two members to be separated. Because the surface area of this wedge-shaped end is relatively small, the ability of the operator to bring suitable forces to bear on the members to be separated is significantly limited. Moreover, because the forces that are brought to bear are concentrated in a relatively small area, that is, over the surface of the wedge-shaped end, exertion of such forces gives rise to undesirable stress concentrations which can lead to cracking, breakage or other damage to the materials intended to be separated.

Typically, wrecking tools should be constructed to be operated in a way that effectively separates joined structural elements while minimizing damage to the separated structural elements and to the surrounding structure. Furthermore, the wrecking tool should be constructed so that it may be readily and effectively employed even in relatively constricted spaces, and for relatively long periods of time. Finally, the wrecking tool should be constructed so that it is capable of being employed in a variety of different orientations and configurations such that work can be efficiently and effectively performed on one or more structural elements in a variety of different ways.

Other proposals have involved floor demolition tools. The problem with these demolition tools is that they do not provide a claw, a tab, and a nail-removing aperture in the same plate area. Also, they require a user to stoop over, kneel, or bend down to engage the floor. Also, the handle used to control the demolition tool is not easily accessible. Even though the above cited floor demolition tools meet some of the needs of the market, a floor demolition tool that engages the floor for removing, scraping, prying, flipping, and replacing components on, and integral, with the floor in an efficient manner, and that leverages the shape and length of the tool so that a user does not require stooping over, kneeling, or bending down to engage the floor, and also provides a central aperture and both straight and curvilinear edges and claws that facilitate engagement with boards, tiles, adhesives, and nails on the floor, is still desired.

SUMMARY

Illustrative embodiments of the disclosure are generally directed to a multipurpose floor demolition tool and method of operation. The floor demolition tool serves to engage a floor in different variations and manipulations to remove, scrape, pry, flip, and replace components on, and integral with the floor in an efficient manner that leverages the shape and length of the tool. In one embodiment, the floor demolition tool provides a central aperture and both straight and curvilinear edges and claws that enable facilitated engagement with boards, tiles, adhesives, and nails from a floor. The floor demolition tool facilitates such demolition of the floor by not requiring a user to stoop over, kneel, or bend down to engage the floor.

In some embodiments, the floor demolition tool comprises a generally flat plate defined by an aperture. The plate is further defined by a straight scraping edge. The plate is further defined by a first curvilinear edge comprising a first claw disposed coplanar with the plate, the first claw having a sharp apex. The plate is further defined by a second edge comprising a tab extending perpendicularly from the plate.

The plate is further defined by a straight mounting edge. The tool further comprises a handle comprising a proximal end and a distal end. The distal end is joined with the straight mounting edge of the plate.

In another aspect, the plate is fabricated from metal.

In another aspect, the plate has a rectangular shape.

In another aspect, the aperture is centrally disposed in the plate.

In another aspect, the aperture has a generally tear drop shape defined by a wide end and a narrow end.

In another aspect, the wide end of the aperture has a tapered edge.

In another aspect, the aperture is operable to enable passage of a nail head.

In another aspect, the first claw is generally hook-shaped.

In another aspect, the straight scraping edge is tapered.

In another aspect, further comprising a bridge extending between the tab of the second edge and the plate.

In another aspect, further comprising a bracket for fastening the distal end of the handle to the straight mounting edge of the plate.

In another aspect, the distal end of the handle is integrally joined with the straight mounting edge of the plate.

In another aspect, the tab has a tapered edge.

One objective of the present invention is to enable a floor installer to scrape, pry, and flip floor components while standing up; and thereby not require the floor installer to stoop down or work on the knees to demolish the floor.

Another objective is to provide a plate having a straight front edge that scrapes a floor.

Another objective is to provide a plate having a lateral curvilinear edge to engage the floor or flat substrate simultaneously from one edge of the plate.

Another objective is to provide an aperture that is tapered to receive and grip a nail head, and circular at a wide end to retain the nail by the nail head.

Another objective is to provide a claw that can grip components of the floor, including nails, wall boards, tiles, and the like.

Another objective is to provide a pair of claws on each edge of the plate disposed at different orientations.

Another objective is to provide a tab perpendicular to the plate for prying floor components, such as panels and nails.

Another objective is to provide a handle that creates leverage on the plate for prying floor components.

Another objective is to construct a tool that is readily and effectively employed even in relatively constricted spaces, and for relatively long periods of time.

Another objective is to construct a tool that capable of being employed in a variety of different orientations and configurations such that work can be efficiently and effectively performed on one or more structural elements in a variety of different ways.

Another objective is to provide an inexpensive to manufacture multipurpose floor demolishing tool.

Other systems, tools, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
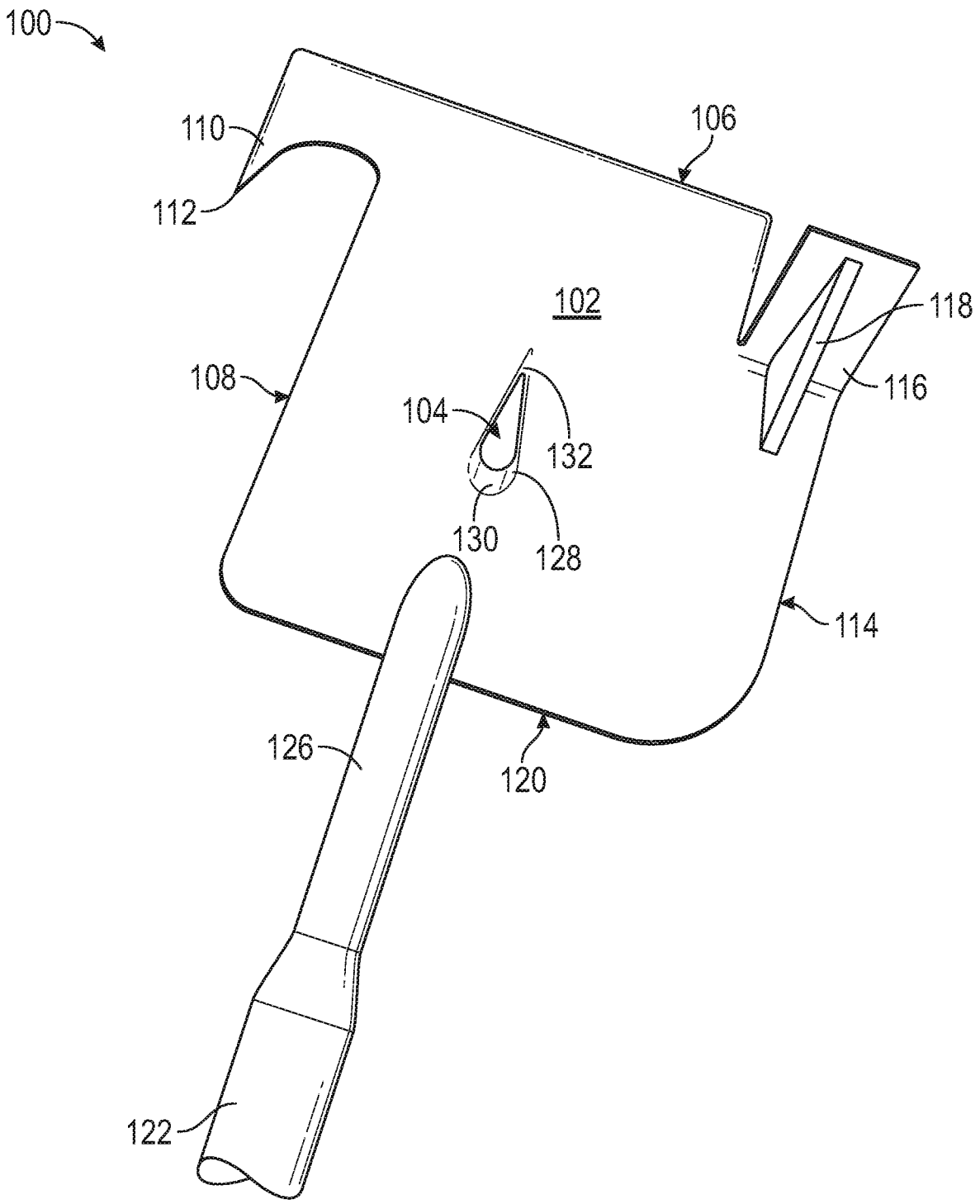
FIG. 1 illustrates a front view of an exemplary multipurpose floor demolition tool, showing a plate having a straight scraping edge, a first curvilinear edge with a claw, a second edge with a tab, and a rear mounting edge, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific tools and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A multipurpose floor demolition tool 100 is referenced in FIGS. 1-4. The multipurpose floor demolition tool 100, hereafter "tool 100" is a tool that is operated by a floor installer from an upright position while demolishing, scraping, prying, and flipping a floor or flat substrate, and various floor components, i.e., tiles, boards, vinyl, nails, adhesives.

The tool 100 is configured with various straight edges 106, curvilinear edges 108, 114, claws 110, 116, apertures 104, and handle 122 that form an interdependent synergy that enables optimal demolition of the floor without the need to bend over, and allows for effective demolition with a lesser application of force than presently required with the known flooring tools. The tool 100 is especially effective for facilitated scraping of adhesives and residues from the floor, removal of an embedded nail from the floor, and prying of a tile, board, vinyl, or other floor covering from the floor.

Those skilled in the art will recognize that demolishing, or replacing a floor requires multiple functions, including prying off boards, tiles, or carpets; scraping off adhesives; flipping tiles and boars; and removing nails from the floor or flat substrate. For example, in carpet laying and vinyl installation, installers must remove vinyl or other floor covering from a floor that involves cove base. The old vinyl is underneath the cove base. The old vinyl and cove base must be pried off, and adhesives scraped off in a short period of time.

This type of floor installation work requires a tool that has straight edges and an elongate handle for prying. Also, a curvilinear edge may be necessary to adapt to corners and wall boards. This may require multiple tools and scrapers. Further, this type of labor often requires the installer to bend over or work on the knees, which is taxing and time consuming. The present tool 100 provides multiple edges 106, 108, 114, 120, an aperture 104, and claws 110, 116 that form on a single plate 102 to create a multipurpose functionality; and further provides an elongate handle 122 attached to the plate 102 to enable working on the floor from an upright position.

As FIG. 1 references, the tool 100 comprises a plate 102 that serves as the primary engagement surface with the floor 400 and floor components. The plate 102 is rigid and generally flat, so as to enable effective scraping of the floor 400 and prying of floor components. The flat shape of the plate 102 allows operation of the tool 100 in relatively constricted spaces, and for relatively long periods of time. In one embodiment, the plate 102 has a generally rectangular configuration. Though in other embodiments, the plate may be square or wedge shaped. Suitable materials for the plate 102 may include, without limitation, steel, aluminum, iron, and a metal alloy.

In one embodiment, the plate 102 is rectangular and defined by four distinct edges 106, 108, 114, 120 that perform independent, yet correlating functions. For example, a most forward straight edge 106 scrapes at the forward end of the plate 102, while a pair of lateral curvilinear edges 108, 114 simultaneously scrape a floor 400 or flat substrate to the sides of the plate 102, and a pair of claws 110, 116 extend from the curvilinear edges 108, 114 are disposed at different orientations to provide greater leverage for removal of protrusions, nails, and such from the floor 400.

Figure 2:
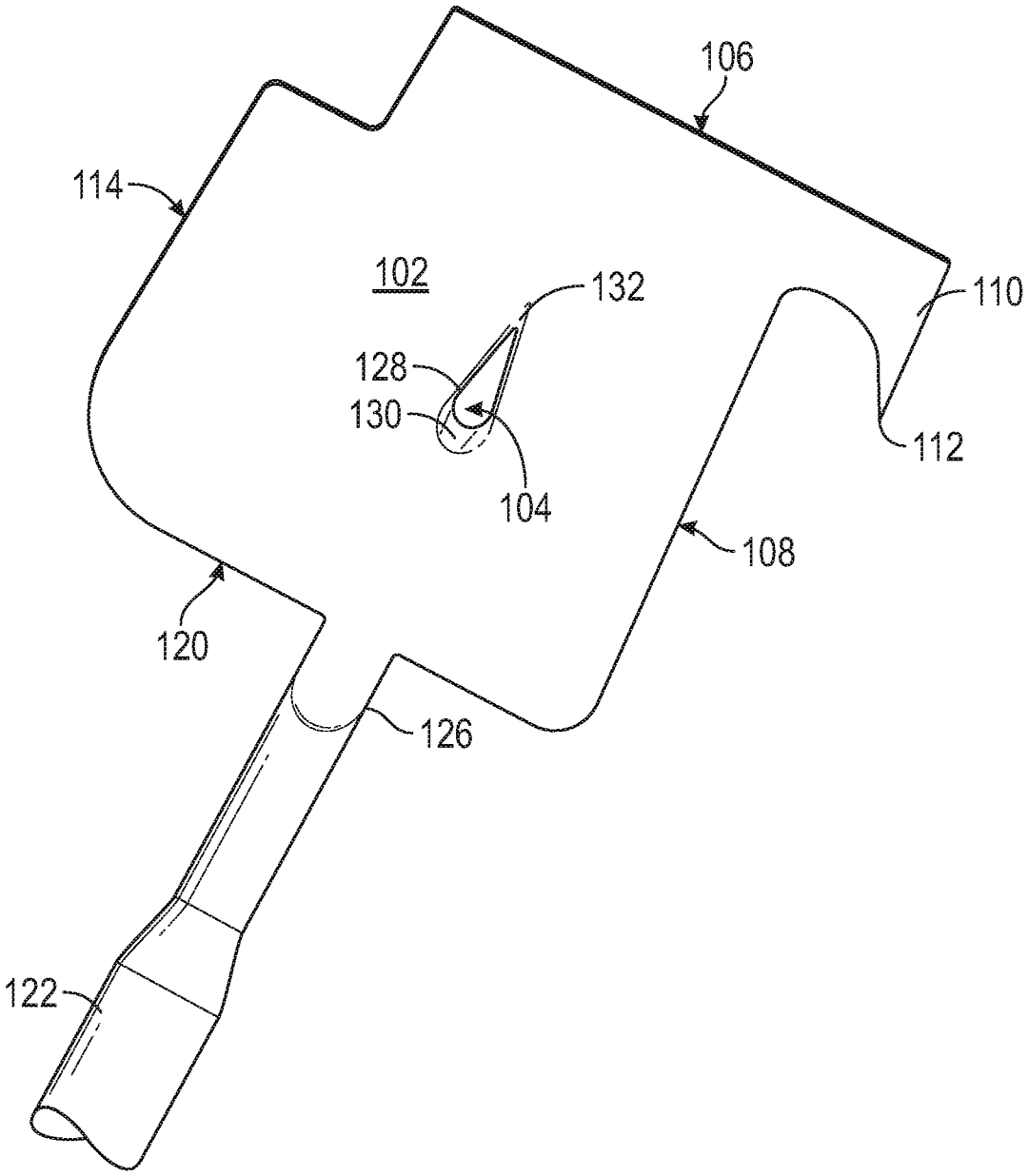
FIG. 2 illustrates a rear view of the multipurpose floor demolition tool shown in FIG. 1, in accordance with an embodiment of the present invention.

Looking now at FIG. 2, the plate 102 is also defined by a central aperture 104. Though the aperture may also form close to one of the edges in a nonsymmetrical position on the plate 102. The aperture 104 is sized and dimensioned to enable passage of a nail head for prying a nail from the floor 400. In one non-limiting embodiment, the aperture 104 has a generally tear drop shape defined by a wide end 128 and a narrow end 132. The wide end 128 is generally circular, so as to retain a nail head. The wide end 128 may be defined by a tapered edge 130 that is effective for prying under objects, such as a nail head abutted against the floor 400.

In operation, the nail or protrusion is removed from the floor 400 may by passing the nail head or protrusion through the aperture 104, sliding the tapered edge 130 between the nail head and the floor 400, and then tilting the plate 102 downwardly, so as to pry the nail or protrusion out of the floor 400. This serves essentially as a lever simple machine. The aperture 104, having a tapered edge and a generally circular shape, is sized and dimensioned to pry and retain standard nails used in floors 400 and subfloors.

Figure 6:
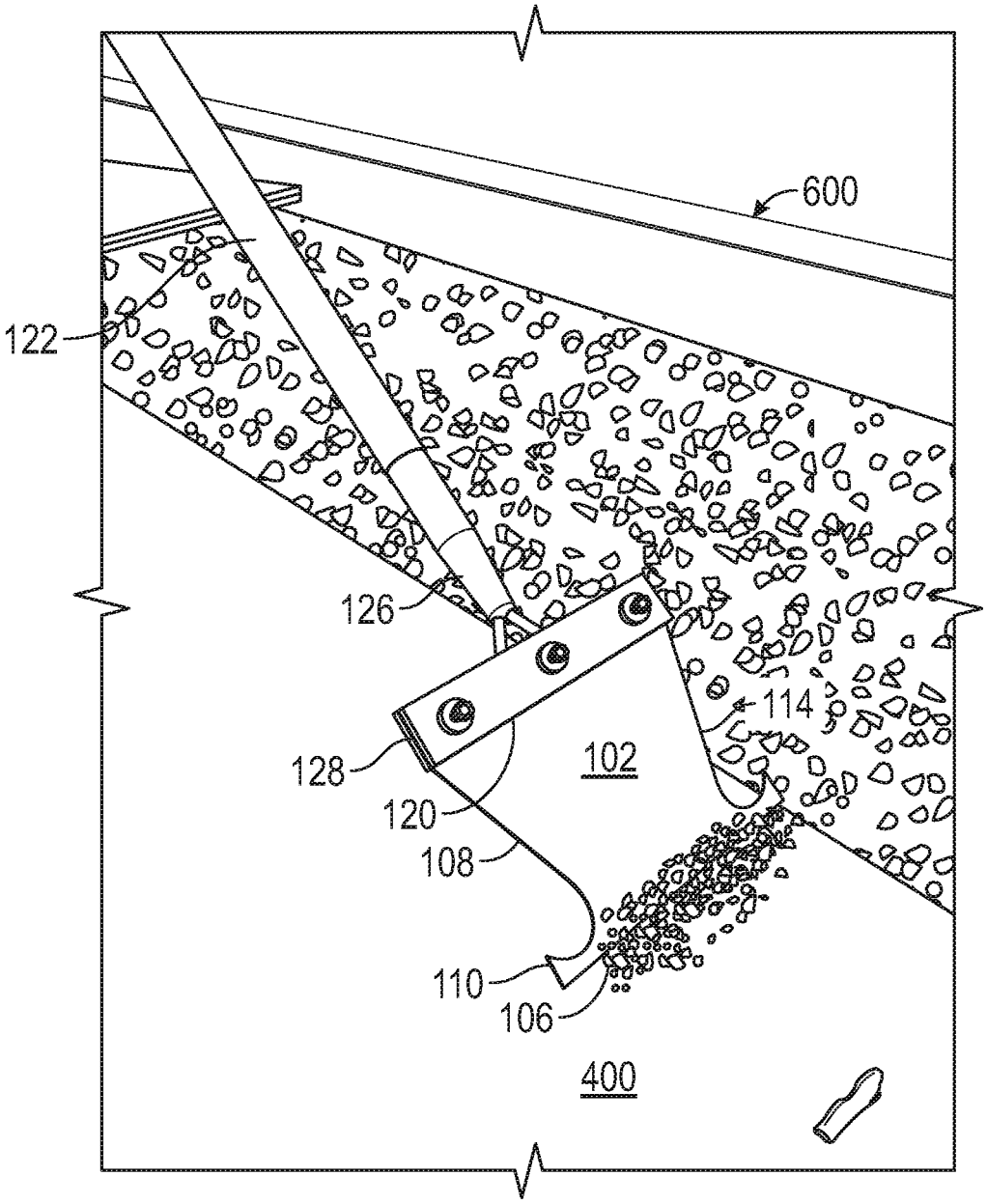
FIG. 6 illustrates a perspective view of the straight scraping edge of the panel scrapping the floor, in accordance with an embodiment of the present invention.

In regards to the edges that form the perimeter of the plate 102, the straight scraping edge 106 is the most forward edge of the plate 102, and thus is the most fully engaged edge on the plate 102. The straight scraping edge 106 is configured to effectively scrape the floor 400 by engaging the floor 400 in a back-and-forth motion. In one embodiment, the straight scraping edge 106 terminates at a sharp edge that enhances scraping capacity. For example, FIG. 6 illustrates a perspective view of the straight scraping edge 106 of the panel scrapping 600 the floor.

The straight scraping edge 106 is also configured to be driven between the two members to be separated—effectively serving as a crowbar. For this purpose, the straight scraping edge 106 has a tapered edge. Because the surface area of the plate 102 and the straight scraping edge 106 is relatively wide, the ability of the operator to bring suitable forces to bear on the members to be separated is magnified. In other embodiments however, the straight scraping edge 106 can be used to chop, cut, tear, and generally demolish the floor 400 and floor components.

Figure 7:
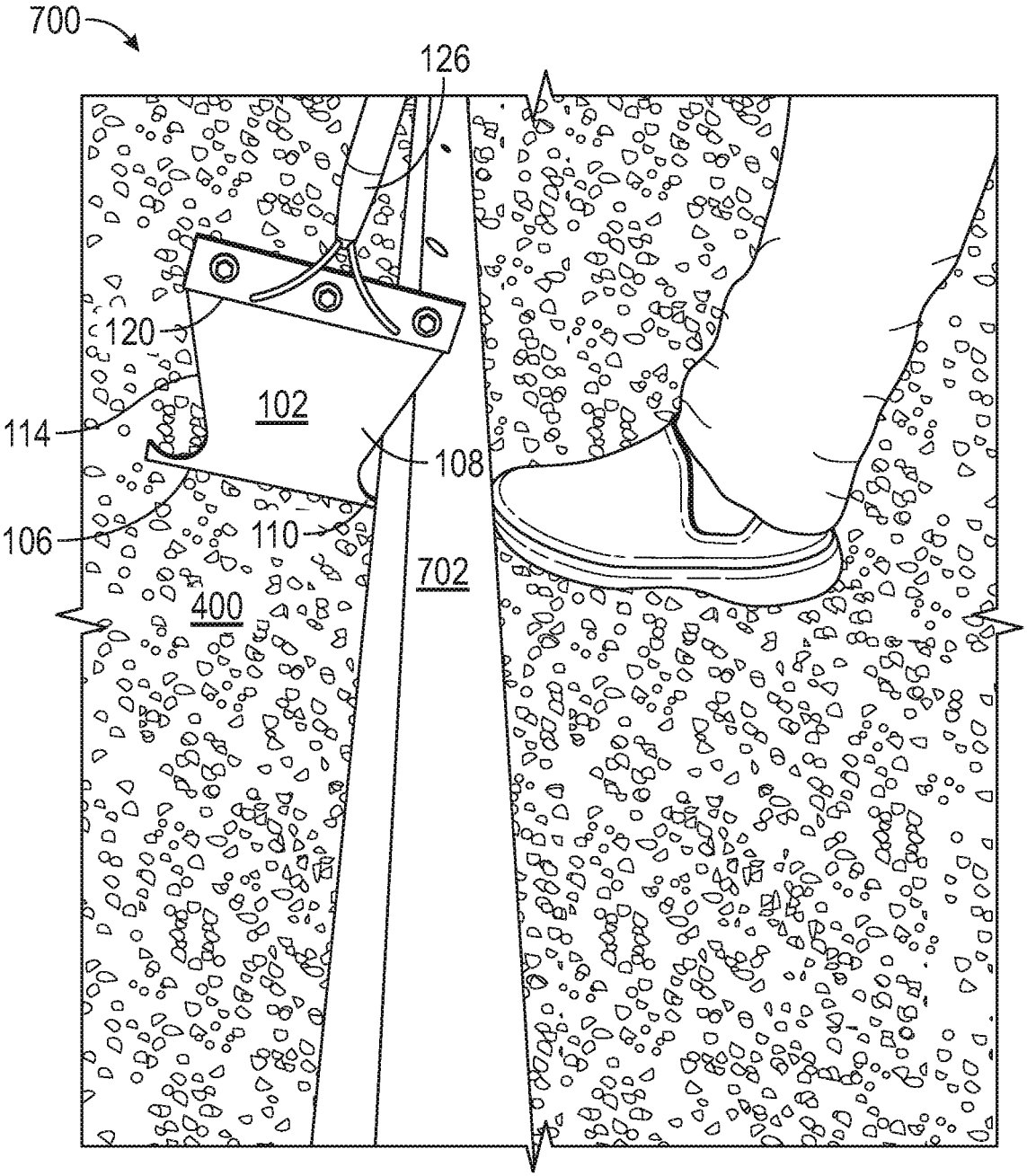
FIG. 7 illustrates a perspective view of the claw of the panel grappling a section of lumber from the floor, in accordance with an embodiment of the present invention.

In some embodiments, a first curvilinear edge 108 is disposed laterally and coplanar to the straight scraping edge 106. The first curvilinear edge 108 may also be used to scrape the floor 400, like the straight scraping edge 106. The curvilinear shape and integral first claw 110 allows for greater functionality to the floor components however, such as prying and flipping. As discussed above, the first curvilinear edge 108 comprises an integral first claw 110 having a generally hook shape and a sharp apex 112. The sharp apex 112 is useful for gripping an edge or corner of a floor 400 covering. In this manner, the first claw 110 is effective for prying, cutting, and battering the floor components. For example, FIG. 7 illustrates a perspective view of the first claw 110 of the panel grappling 700 a section of lumber 702 from the floor 400.

Figure 3:
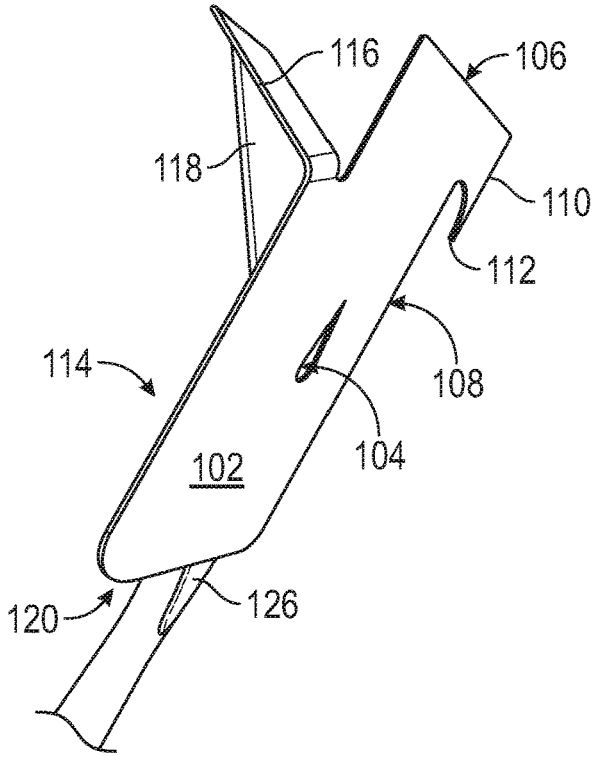
FIG. 3 illustrates a left side view of the multipurpose floor demolition tool shown in FIG. 1, in accordance with an embodiment of the present invention.

As shown in FIG. 3, the plate 102 is also defined by a second edge 114. The second edge 114 may also be used to scrape the floor 400, like the straight scraping edge 106. The curvilinear shape and attached first claw 110 on the first curvilinear edge 108, however, allows for greater functionality to the floor components, such as prying and flipping. The second edge 114 is parallel to the first curvilinear edge 108, such that both curvilinear edges 108, 114 operate simultaneously.

The second edge 114 is defined by an integral tab 116, similarly configured to the first claw 110. The tab 116 can be useful for prying an edge or corner of a floor 400 covering. For this purpose, the tab 116 has a tapered edge. In this manner, the tab 116 is effective for prying, cutting, and battering the floor components. As shown in FIG. 1, a portion of the second edge 114 is disposed perpendicularly from the straight scraping edge 106. This may include a fold in the second edge 114 that positions the tab 116 at a different orientation to the first claw 110. A bridge 118 extends between the plate 102 and the tab 116 to provide reinforcement there between. The bridge 118 is orthogonal to the plate 102. The bridge 118 also provides an additional surface for prying the floor 400.

In essence, about ⅓ of the most forward portion of the second edge 114—the portion with the tab 116—folds upwardly and perpendicular to the straight scraping edge 106, while the remaining ⅔ of the more rearward portion of the second edge 114 remains parallel to the plate 102. In other embodiments, the tab 116 may, however, be folded perpendicular to the straight scraping edge 106 at any point along the second edge 114, including at a midpoint or ⅓ to the rearward portion of the second edge 114.

Figure 8:
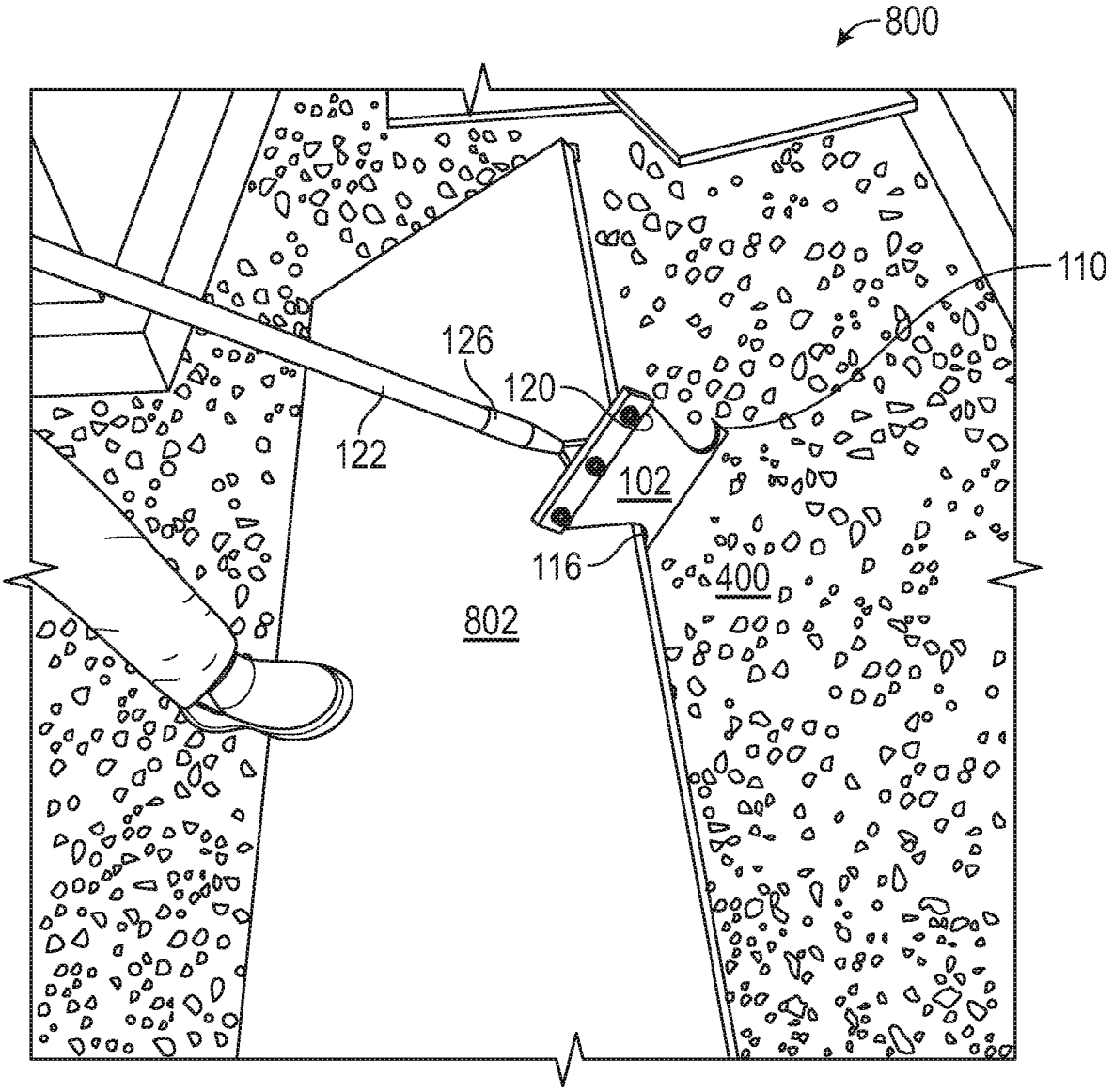
FIG. 8 illustrates a perspective view of the tab of the panel prying a panel off the floor, in accordance with an embodiment of the present invention.

In this manner, the tab 116 can be used to engage floor components from a different angle than the first claw 110. For example, FIG. 8 illustrates a perspective view of the tab 116 of the panel prying 800 a panel 802 off the floor, in accordance with an embodiment of the present invention. This allows for more leverage when engaging the floor 400 and floor components. Further, the lateral disposition of the first and second edges 108, 114 enables simultaneous engagement with the floor 400 and floor components, such as nails, tiles, adhesives, and general floor coverings.

In some embodiments, an elongate handle 122 joins with the straight mounting edge 120 of the plate 102. The handle 122 allows for manipulation of the plate 102, and also provide leverage for prying and scraping the floor components with the plate 102, first claw 110, tab 116, and aperture 104. The handle 122 is defined by a proximal end 124 that may be gripped by a floor 400 installer, and a distal end 126 that fixedly attaches to the straight mounting edge 120. A bracket 212 may be used to affix the distal end to the straight mounting edge. Various fasteners, such as screws, hold the handle 122 in the bracket 212.

In alternative uses of the tool, firefighters and rescue personnel can use the plate 102 to quickly access buildings and other structures in what are often potentially life-threatening conditions. In another embodiment, the claw 116 is effective for prying open locked doors, tearing ceilings, and puncturing air bags. In another embodiment, the tab 116 is effective for lifting lumber, metal slabs, and other objects off the floor. Other uses for the tool 100 related to demolition, rescue, construction, and floor laying may also be used.

Figure 4:
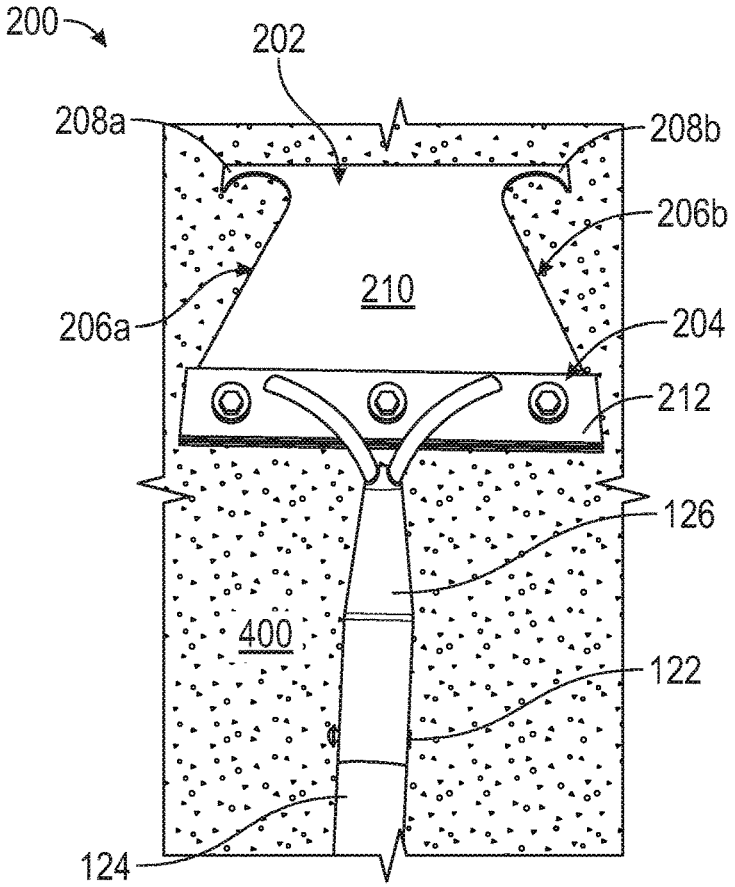
FIG. 4 illustrates a front view of an alternative embodiment of the multipurpose floor demolition tool, showing a pair of identical lateral curvilinear edges, in accordance with an embodiment of the present invention.

FIG. 4 illustrates an alternative embodiment of the tool, illustrating a multipurpose floor demolition tool 200 having identical lateral curvilinear edges 206*a*, 206*b*. The alternative configuration of the tool 200 comprises a plate 210 having a straight scraping edge 202, a rear mounting edge 204, and a pair of identical lateral curvilinear edges 206*a*, 206*b* that taper inwardly from the rear mounting edge 204 to the forward straight scraping edge 202. As above, the pair of identical lateral curvilinear edges 206*a*, 206*b* have a pair of identical claws 208*a*, 208*b* with a hook shape and a generally sharp apex.

The alternative embodiment of the multipurpose floor demolition tool 200 does not, however, utilize an aperture for removing nails. Though a central aperture may be used in other embodiments. Also, neither of the lateral curvilinear edges include a tab that extends perpendicular to the straight scraping edge, as in the multipurpose floor demolition tool 100 discussed above. Nonetheless, the alternative tool 200 works substantially the same as the tool 100 discussed above. For example, as shown in FIG. 6-8, the straight scraping edge 202 is effective for scrapping and flipping floor components. And the pair of identical lateral curvilinear edges 206*a*, 206*b* are configured to simultaneously tear, grip, and flip the floor 400 and floor components with a pair of claws.

In operation of the tool 100, an installer grips the proximal end of the handle 122 and engages the floor 400 with the plate 102. Because of the handle 122, the floor 400 installer is not required to bend over or work on the knees. The floor 400 installer manipulates the forward straight scraping edge 106 in a back-and-forth motion to scrape the floor 400. The first and second edges 108, 114 simultaneously engage the floor 400 in a scraping, gripping, or tearing function. The corresponding claw 110 and tab 116 also are positioned to demolish the floor 400 and floor components as deemed appropriate.

Figure 5:
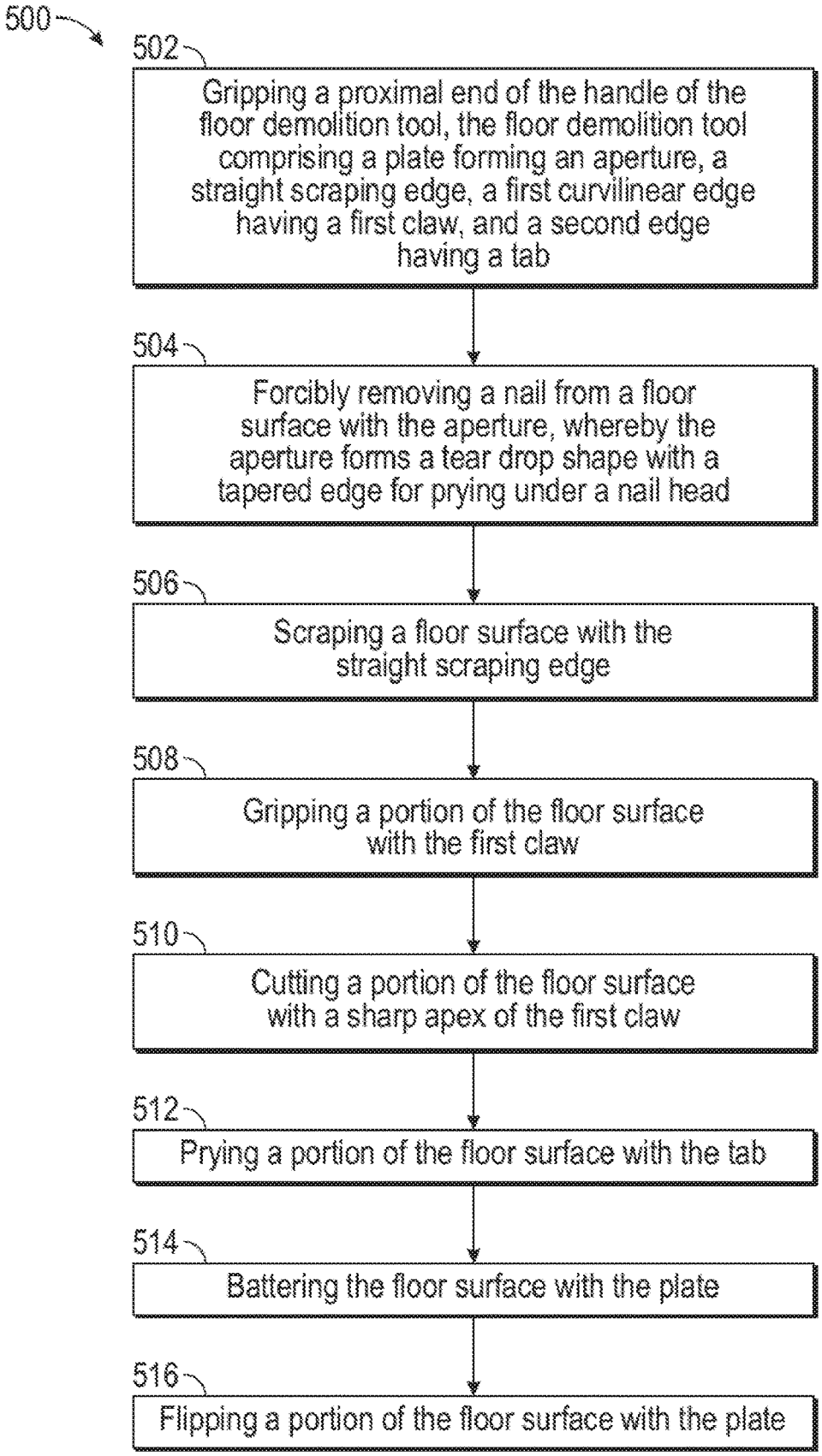
FIG. 5 illustrates a flowchart of an exemplary method of operating a multipurpose floor demolition tool, in accordance with an embodiment of the present invention.

FIG. 5 illustrates a flowchart of an exemplary method 500 of operating a multipurpose floor demolition tool. The method 500 may include an initial Step 502 of gripping a proximal end of the handle of the floor demolition tool, the floor demolition tool comprising a plate forming an aperture, a straight scraping edge, a first curvilinear edge having a first claw, and a second edge having a tab. The method may further comprise a Step 504 of forcibly removing a nail from a floor with the aperture, whereby the aperture forms a tear drop shape with a tapered edge for prying under a nail head.

In some embodiments, a Step 506 includes scraping a floor with the straight scraping edge. FIG. 6 illustrates a perspective view of the straight scraping edge of the panel scrapping 600 the floor. In other embodiments, a Step 508 comprises gripping a portion of the floor with the first claw. FIG. 7 illustrates a perspective view of the first claw of the panel grappling 700 a section of lumber from the floor. A Step 510 includes cutting a portion of the floor with a sharp apex of the first claw. A Step 512 may include prying a portion of the floor with the tab. FIG. 8 illustrates a perspective view of the tab of the panel prying 800 a panel off the floor. A Step 514 comprises battering the floor with the plate. A final Step 516 includes flipping a portion of the floor with the plate.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A multipurpose floor demolition tool, the tool comprising:

a plate having an aperture, the plate further being defined by a first claw disposed coplanar with a portion of the plate, the first claw having a sharp apex, the plate being further defined by a straight scraping edge that further defines the first claw, the plate being further defined by a first edge terminating at the apex of the first claw, the first edge being curvilinear so as to further define the first claw, the plate further being defined by a tab, the tab projecting at an angle from the portion of the plate, the plate being further defined by a second edge, the second edge being at least partially parallel to the first edge, the second edge terminating at the tab, the plate being further defined by a straight mounting edge disposed parallel to the straight scraping edge;

a bridge extending between the tab and the portion of the plate, the bridge engaging the portion of the plate and the tab; and a handle comprising a proximal end and a distal end, the distal end being joined with the straight mounting edge of the plate.

2. The tool of claim 1, wherein the plate is fabricated from metal.

3. The tool of claim 1, wherein the portion of the plate has a rectangular shape.

4. The tool of claim 1, wherein the aperture is centrally disposed in the plate.

5. The tool of claim 1, wherein the aperture has a generally tear drop shape defined by a wide end and a narrow end.

6. The tool of claim 5, wherein the wide end of the aperture has a tapered edge.

7. The tool of claim 1, wherein the first claw is generally hook-shaped.

8. The tool of claim 1, wherein the tab has a tapered edge.

9. The tool of claim 1, wherein the straight scraping edge is tapered.

10. The tool of claim 1, further comprising a bracket for fastening the distal end of the handle to the straight mounting edge of the plate.

11. The tool of claim 1, wherein the distal end of the handle is integrally joined with the straight mounting edge of the plate.

* * * * *